US006598271B2

(12) United States Patent
Nire

(10) Patent No.: US 6,598,271 B2
(45) Date of Patent: Jul. 29, 2003

(54) CLASP

(75) Inventor: Takao Nire, Tokyo (JP)

(73) Assignee: Yamato Trading Nire Co. Ltd., Tokyo (JP)

( * ) Notice: Subject to any disclaimer, the term of this patent is extended or adjusted under 35 U.S.C. 154(b) by 0 days.

(21) Appl. No.: 10/028,959

(22) Filed: Dec. 18, 2001

(65) Prior Publication Data

US 2002/0112323 A1 Aug. 22, 2002

(30) Foreign Application Priority Data

Dec. 26, 2000 (JP) ..... 2000-404740

(51) Int. Cl.[7] ..... A44B 21/00
(52) U.S. Cl. ..... 24/303; 24/265 WS
(58) Field of Search ..... 24/303, 265 BC, 24/265 EC, 265 WS, 616, 584.1

(56) References Cited

U.S. PATENT DOCUMENTS

| | | | | |
|---|---|---|---|---|
| 2,615,227 A | * | 10/1952 | Hornik | 24/303 |
| 2,648,884 A | * | 8/1953 | Loofboro | 24/303 |
| 3,293,714 A | * | 12/1966 | Shafer | 24/303 |
| 4,231,137 A | * | 11/1980 | Fujimoto | 24/303 |
| 4,941,236 A | * | 7/1990 | Sherman et al. | 24/303 |
| 5,664,298 A | * | 9/1997 | Nessar-Ivanovic | 24/303 |
| 6,292,985 B1 | * | 9/2001 | Grunberger | 24/303 |

* cited by examiner

*Primary Examiner*—Robert J. Sandy
(74) *Attorney, Agent, or Firm*—Ladas & Parry

(57) ABSTRACT

A clasp suitable as button for clothes, buckle for belt or the like adapted to facilitate operation of fastening and unfastening.

A clasp comprising a pair of basic bodies provided on mutually opposed surfaces thereof with a pair of magnets and recess and projection cooperating with each other to serve as lock means, respectively, the basic bodies adapted to be detachably coupled together as the projection is engaged with the recess and the magnets attract each other so that at least sliding shift of the basic bodies from each other in horizontal direction is restricted by engagement of the projection and recess. In another aspect, the invention proposes a clasp comprising a pair of basic bodies, each being divided by a level differentiating vertical surface into a front half and a rear half, the front half being defined by the level differentiating vertical surface and a level differentiating horizontal surface provided with a magnet and projection or recess serving as one of lock means so that the pair of basic bodies are detachably coupled to each other as the projection and recess come in engagement and the magnets attract each other wherein, once the pair of basic bodies have been coupled to each other, front end surfaces of the respective front halves bear against the associated level differentiating vertical surfaces and thereby restrict the pair of basic bodies from swinging around the projection and recess engaged with each other.

12 Claims, 6 Drawing Sheets

CLASP

BACKGROUND OF THE INVENTION

1. Technical Field of the Invention

The present invention relates to a clasp such as a button for clothes or buckle for belt.

2. Description of the Related Art

While various types of clasp have already been developed and available, it has not always been easy to fasten or unfasten these conventional types of clasp.

Problem to be Solved by the Invention

It is a principal object of the present invention to provide a clasp such as a button for clothes or a buckle for belt improved so that the clasp can be easily fastened or unfastened. Another object of the invention is to provide such clasp particularly improved so that the clasp can be reliably and stably fastened.

Measure to Solve the Problem

The object set forth above is achieved, according to one aspect of the present invention, by a clasp comprising a pair of basic bodies provided on mutually opposed surfaces thereof with a pair of magnets and recess and projection cooperating with each other to serve as lock means, respectively, the basic bodies adapted to be detachably coupled together as the projection is engaged with the recess and said magnets attract each other so that at least sliding shift of the basic bodies from each other in horizontal direction is restricted by engagement of the projection and recess.

The object set forth above is achieved, according to another aspect of the present invention, by a clasp comprising a pair of basic bodies, each being divided by a level differentiating vertical surface into a front half and a rear half, the front half being defined by the level differentiating vertical surface and a level differentiating horizontal surface provided with a magnet and projection or recess serving as one of lock means so that the pair of basic bodies are detachably coupled to each other as the projection and recess come in engagement and the magnets attract each other wherein, once the pair of basic bodies have been coupled to each other, front end surfaces of the respective front halves bear against the associated level differentiating vertical surfaces and thereby restrict the pair of basic bodies from swinging around the projection and recess engaged with each other.

Once the pair of basic bodies have been coupled to each other with the pair of front halves engaged with each other, the pair of basic bodies are substantially flush with each other along a boundary of them. One of the front halves is provided on its level differentiating horizontal surface with the magnet and the projection serving as one component of the lock means and the other front half is provided on its level differentiating horizontal surface with the magnet and the recess opposed to the projection and serving as the other component of the lock means so that the pair of basic bodies may be detachably coupled to each other as the projection is engaged with the recess and simultaneously the magnets attract each other. The magnets are fixed inside respective non-magnetic frames. The projection and the recess serving as the lock means are non-magnetic and the recess is formed in the frame.

The projection and the recess serving as the lock means are provided adjacent a front end of the one front half and adjacent a rear end of the other front half, respectively. Once the non-magnetic projection formed on the front half of the one basic body has come in contact with the upper surface of the rear half of the other basic body as the pair of basic bodies get nearer to each other, the projection is guided to slide on the upper surface of the rear half until the projection gets over the level differentiating vertical surface whereupon the magnets attract each other and simultaneously the projection is engaged with the recess opposed to the projection so that the pair of basic bodies are coupled to each other in a predetermined position-relationship. The upper surfaces of the respective rear halves are smooth.

Once the non-magnetic projection formed on the front half of the one basic body has come in contact with the upper surface of the magnet lying on the level differentiating horizontal surface of the other front half as the pair of basic bodies get nearer to each other, the pair of magnets get near to each other under the magnetic attraction and simultaneously the projection slides on the upper surface of the magnet toward the recess until the pair of magnets are magnetically coupled to each other and simultaneously the projection is engaged with the recess opposed to the projection so that the pair of basic bodies are coupled to each other in a predetermined position-relationship. The pair of magnets provided on the respective level differentiating horizontal surfaces are identical to each other in surface shape as well as in size. The front half and the rear half are dimensioned to have a substantially same length and the rear halves are formed in lower sides thereof with recesses.

DESCRIPTION OF THE PREFERRED EMBODIMENTS

Figure 1:
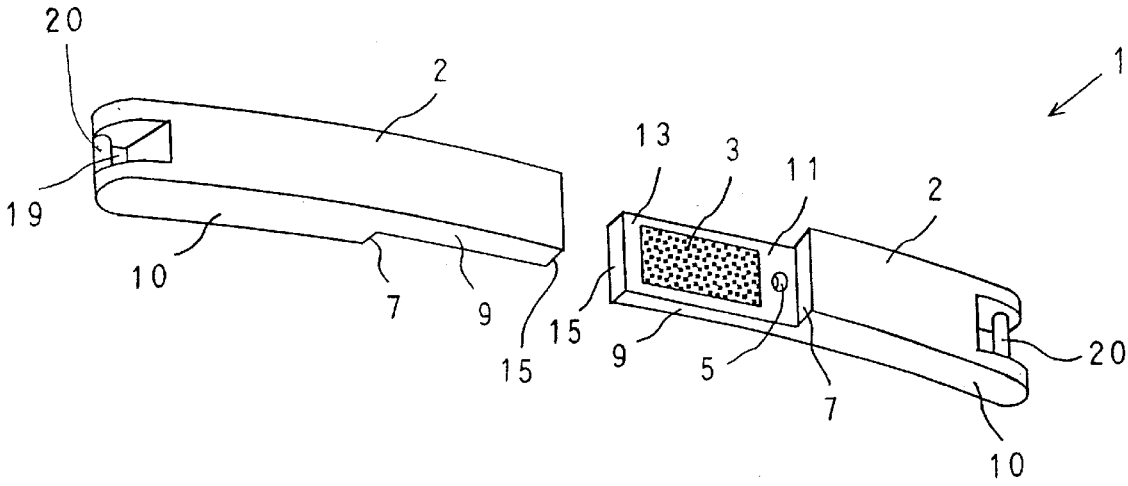
FIG. 1 is a perspective view showing the clasp according to the invention in its unfastened state.
Figure 2:
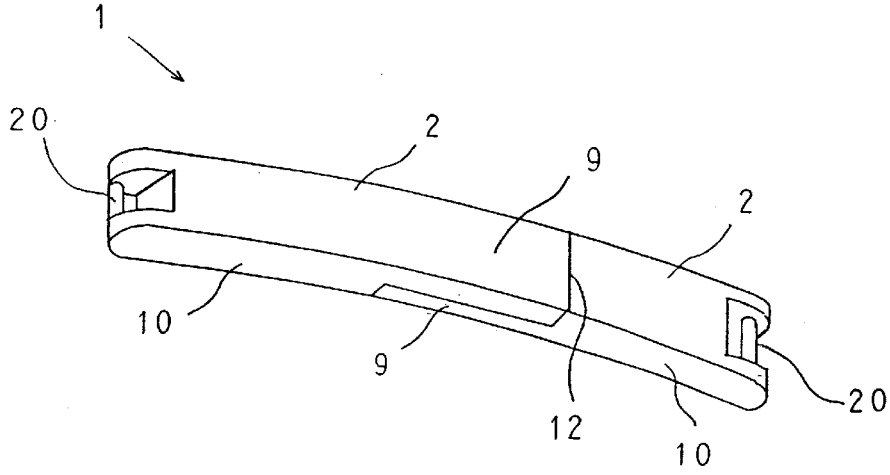
FIG. 2 is a perspective view showing the clasp of FIG. 1 in its unfastened state.
Figure 3:
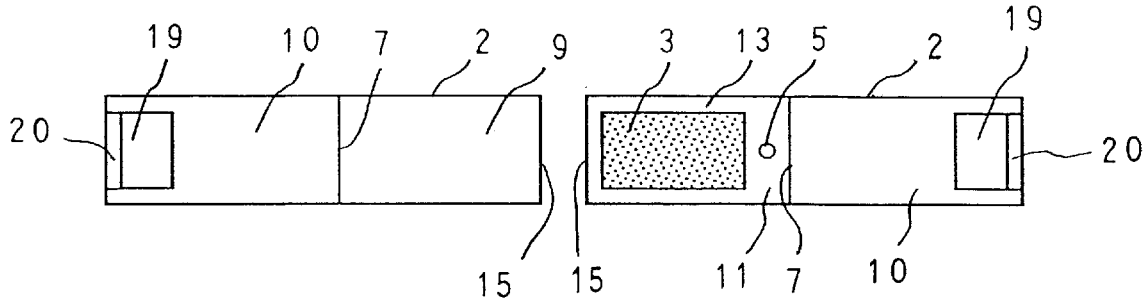
FIG. 3 is a plan view showing the clasp according to the invention in its unfastened state.

Details of the clasp according to the present invention in the form of, for example, a button for clothes or a buckle for belt will be more fully understood from the description of a typical embodiment of this invention given hereunder in reference with the accompanying drawings. Before description of the invention, it should be understood that the present invention is not limited to the button for clothes and the buckle for belt but also applicable to the other articles. A clasp 1 comprises a pair of basic bodies 2, 2, and these basic bodies 2, 2 are magnets 3, 3 and lock means in the form of recess and projection 5, 6, respectively. The magnets 3, 3 as well as those recess and projection 5, 6 are provided on surfaces of the respective basic bodies 2, 2 opposed to each other as the clasp 1 is fastened. The respective magnets 3, 3 are in polarity opposed relation (the polarity on the upper side of the one magnet is positive while the polarity on the upper side of the other magnet is negative). The pair of basic bodies 2, 2 are detachably coupled to each other as the projection 6 of the one basic body 2 comes in engagement with the recess 5, and the magnets 3, 3 are magnetically attracted against each other.

Each of the basic bodies 2, 2 is divided into a front half 9 and a rear half 10 by a vertical surface 7 defining a level difference. Thus the front half 9 has the vertical surface 7 and a horizontal half 11. The front half 9 has a height (i.e., a thickness) corresponding to ½ of that of the rear half 10 so that, with the pair of basic bodies 2, 2 coupled together, a total height of the front halves 9, 9 is substantially equal to that of the respective rear halves 10. Also with the pair of basic bodies 2, 2 coupled together, the front half 9 is substantially flush with the rear half 10 on along a boundary between these halves 9, 10 and this is true not only on the upper side but also on the lower side. The horizontal surfaces 11, 11 are provided with the pair of magnets 3, 3 and the lock means in the form of the recess 5 and the projection 6, respectively. With the basic bodies 2, 2 coupled together, the magnets 3, 3 magnetically attract each other and the set of recess 5 and projection 6 comes in engagement with each other. The magnets 3, 3 are firmly bonded to the respective horizontal surfaces 11 by means of adhesive or the like to as to be surrounded by (rectangular) non-magnetic frames 13.

Figure 4:
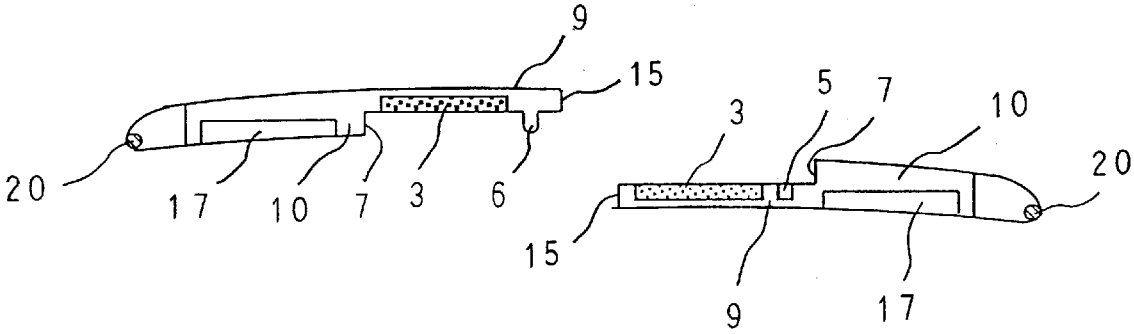
FIG. 4 is a sectional view showing the clasp of FIG. 3.
Figure 5:
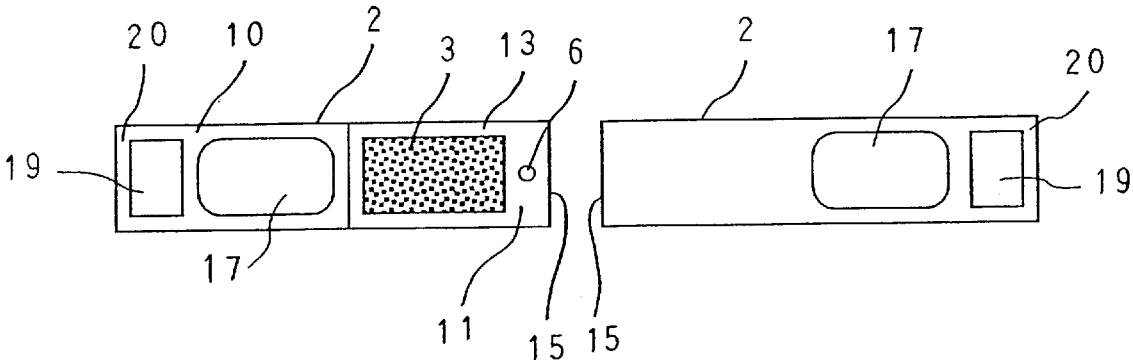
FIG. 5 is a rear view showing the clasp of FIG. 3.
Figure 6:
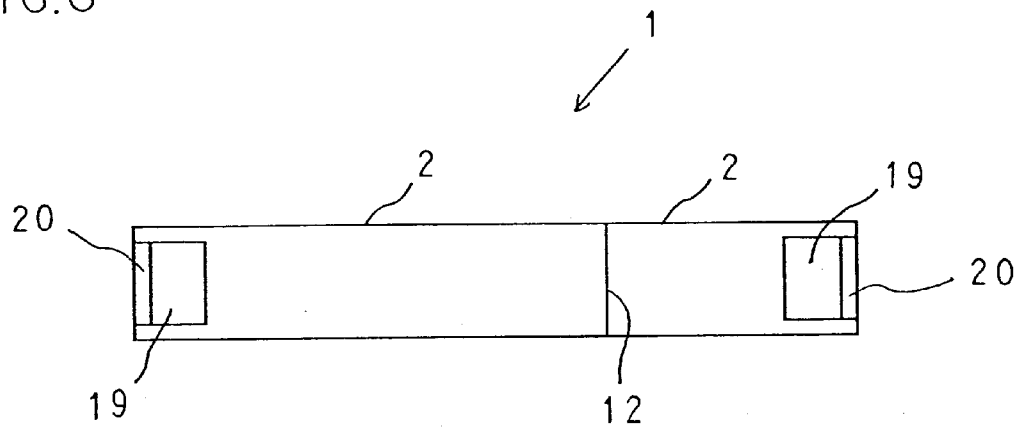
FIG. 6 is a plan view showing this clasp according to the invention in its fastened state.
Figure 7:
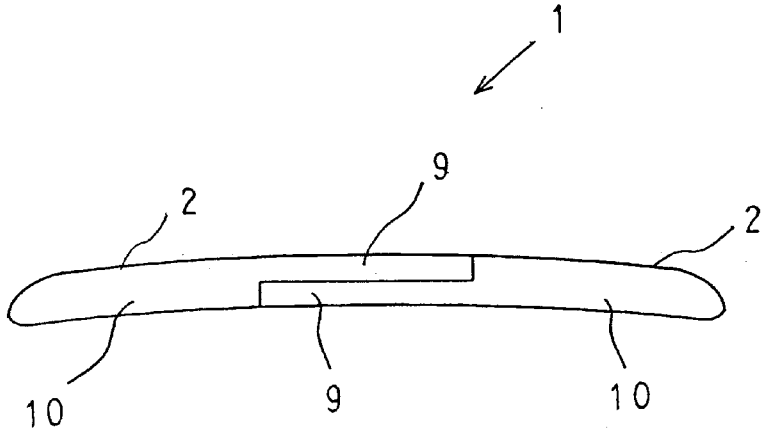
FIG. 7 is a front view showing the clasp of FIG. 6.
Figure 8:
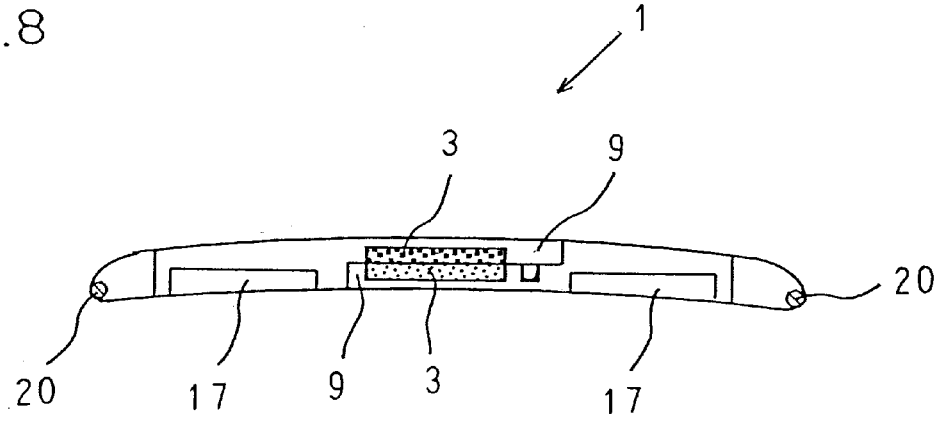
FIG. 8 is a sectional view showing the clasp of FIG. 6.
Figure 9:
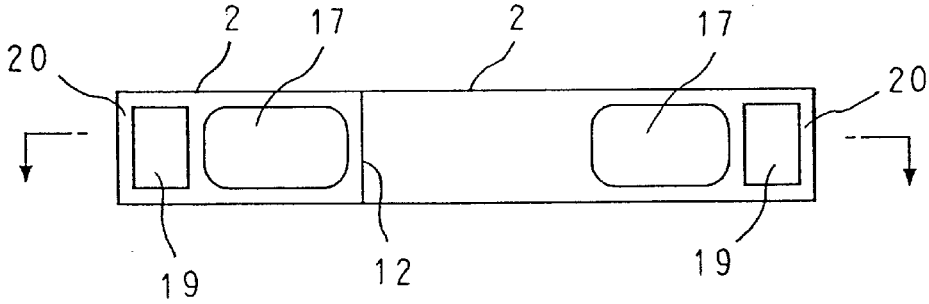
FIG. 9 is a rear view showing the clasp of FIG. 6.

Once the pair of basic bodies 2, 2 have been coupled together in this manner, any sliding shift (except angular shift) relative to each other in horizontal direction is reliably prevented by interlocking of the recess 5 and the projection 6. In the case of the embodiment shown by FIG. 4, the one front half 9 is provided on its horizontal surface 11 with a single projection 6 and the other front half 9 is provided in its horizontal surface 11 with a single recess 5. The projection 6 lies adjacent the front end of the one front half substantially in the middle transversely of the horizontal surface 11. The recess 5 lies adjacent the rear end of the other front half 9 substantially in the middle transversely of the horizontal surface 11 and the corresponding projection 6 is non-magnetic extends upward from the non-magnetic frame 13 surrounding the magnet 3 and the corresponding recess 5 is formed in the non-magnetic frame 13 surrounding the magnet 3. The non-magnetic frame 13 may be made of non-magnetic metallic material.

Figure 12:
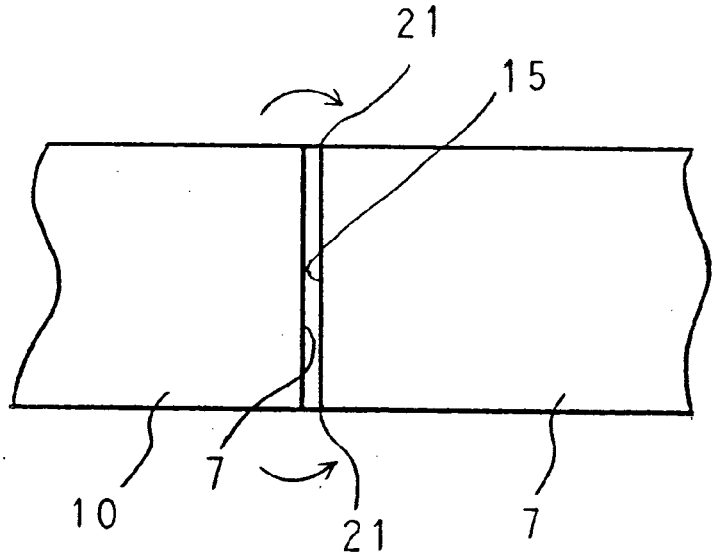
FIG. 12 is a fragmentary scale-enlarged plan view showing the position at which the clasp of FIG. 6 has been fastened.
Figure 13:
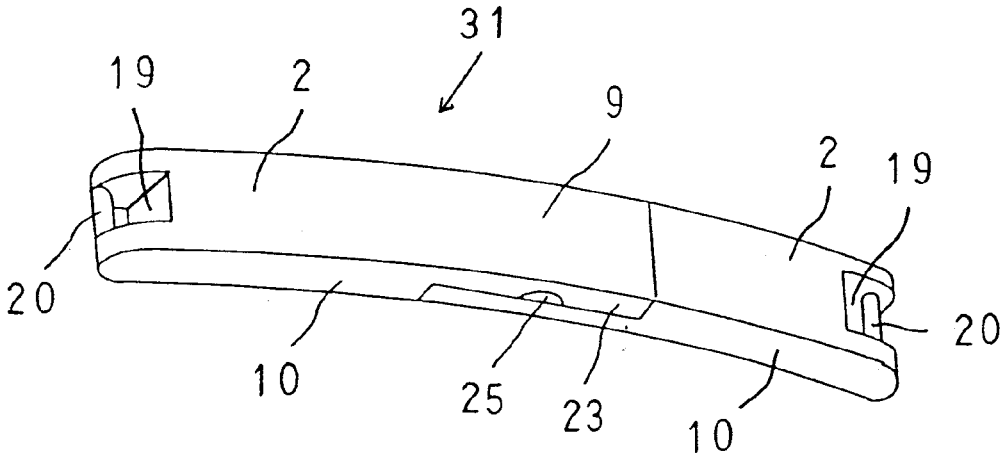
FIG. 13 is a perspective view showing another embodiment of the clasp in its fastened state.
Figure 14:
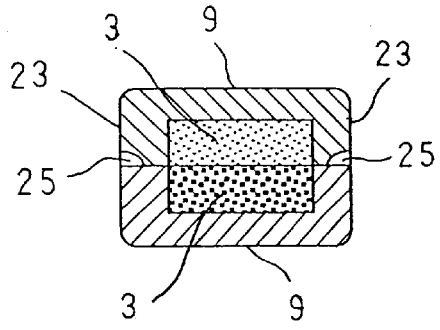
FIG. 14 is a scale-enlarged sectional view showing this clasp in its fastened state.
Figure 15:
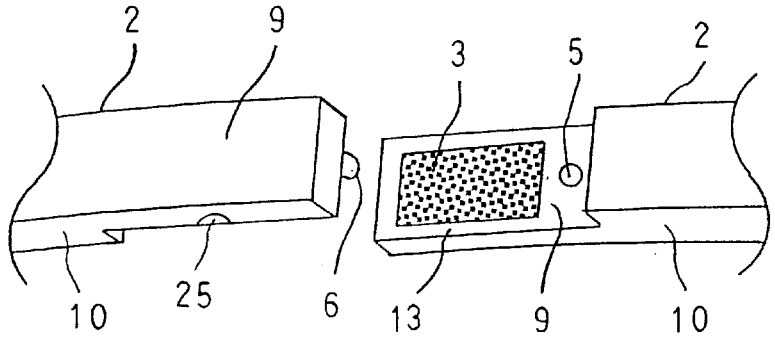
FIG. 15 is a scale-enlarged, perspective view showing the clasp partially in its unfastened state, lock means consisting a cylindrical projection and cylindrical recess.

The basic bodies 2, 2 coupled together may sometimes relatively rotate around the lock means 5, 6 (in horizontal direction as indicated by an arrow in FIG. 12) particularly when there are gaps between the front end surfaces 15 of the respective front halves and the respective vertical surfaces 7 and there is provided the single set of recess 5 and projection 6. However, such relative rotation is effectively restricted as the front end surfaces (more specifically, corners 21 of the respective front end surfaces) of the respective front halves bear against the respective vertical surfaces 7 (See FIG. 12). Undesirable relative rotation of the basic bodies 2, 2 can be effectively restricted so far as the front end surface 15 of at least one front half 9 bears against the vertical surface 7 opposed to this front end surface 15. Obviously, the relative rotation of the basic bodies 2, 2 can be more reliably restricted by an arrangement such that the front end surface 15 of the other front half 9 also may bear against the vertical surface 7 opposed to this front end surface 15.

Rather than the single set of recess 5 and projection 6, plural sets of recess 5 and projection 6 may be provided. The set of recess 5 and projection 6 may be increased to restrict rotation of the basic bodies relative to each other around these interlocked recesses and projections (not shown) with correspondingly higher reliability. In this way, at least sliding shift of the once coupled basic bodies in horizontal direction can be restricted by these recess 5 and projection 6 engaged with each other.

The magnets 3, 3 attract each other and the single or plural sets of recess 5 and projection 6 come in mutual engagement, respectively, as the pair of basic bodies get nearer to each other, until these basic bodies are coupled to each other in a predetermined position-relationship. The pair of basic bodies get nearer to each other usually in vertical direction or in horizontal direction or even in combined direction (the pattern in which these basic bodies get nearer to each other is not specified). Independently of the pattern in which the basic bodies get nearer to each other, the pair of basic bodies 2, 2 are coupled to each other in the predetermined position-relationship as (the front halves 9, 9 carrying the magnets 3, 3 of) the basic bodies 2, 2 get nearer to each other.

There may occur a case in which the pair of basic bodies 2, 2 each divided by the vertical surface 7 into the front half 9 and the rear half 10 can not be coupled to each other in the predetermined position-relationship by instantaneous operation of bringing these basic bodies near to each other. In this case, (the front end of) the projection 6 first bearing against the upper surface 16 of the rear half of the other basic half may be guided along the upper surface 16 of the rear half to the recess 5 of the other basic body (in the direction as indicated by an arrow in FIG. 10) as the pair of basic bodies 2, 2 are brought near to each other. Upon getting over the vertical surface 7, the projection 6 is engaged with the recess 6 partly under the magnetically attractive effect of the magnets 3, 3 and thus the basic bodies 2, 2 are coupled together in the predetermined position-relationship. For this case, the upper surface 16 of the rear half is preferably smooth so that (the front end of) the projection 6 may smoothly slide on the upper surface 16 of the rear half.

Figure 10:
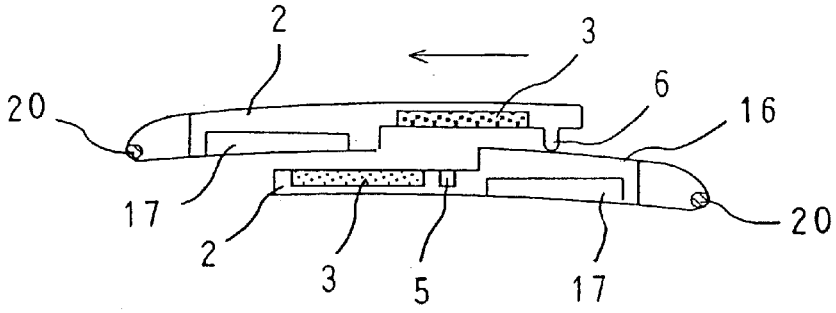
FIG. 10 is a diagram illustrating a manner in which the clasp of FIG. 6 is fastened.
Figure 11:
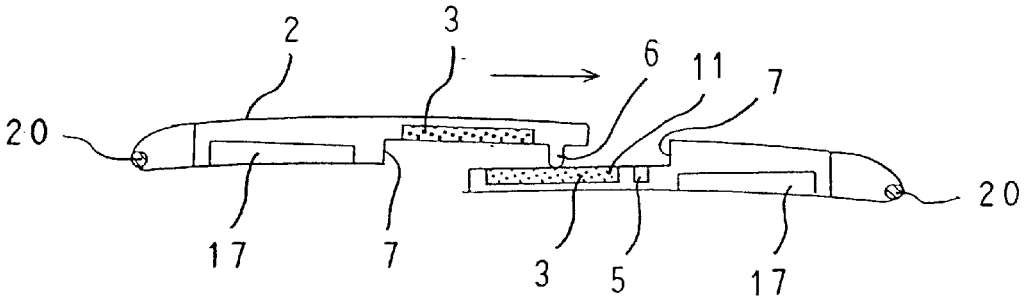
FIG. 11 is a diagram illustrating an alternative manner in which the clasp of FIG. 6 is fastened.

There may also occur a case in which (the front end of) the projection 6 bears first against the horizontal surface 11 of the front half. In this case, the non-magnetic projection 6 of the one front half 9 bears against the surface of the magnet 3 lying on the horizontal surface 11 of the other front half 9 and then slides on the surface of the magnet 3 toward the recess 5 of the other front half (in the direction as indicated by an arrow in FIG. 11) as the basic bodies 2, 2 get nearer to each other. Finally, the magnets 3, 3 properly attract each other and the recess 5 is engaged with the projection 6 to couple the basic bodies 2, 2 together in the predetermined position-relationship. It should be understood that the direction indicated by the arrow in FIGS. 10, 11 is only for the purpose of illustrating an example of the manner in which the pair of magnets 3, 3 get nearer to each other.

Force in horizontal direction as well as in vertical direction is exerted on the pair of basic bodies 2, 2 (not in coupled state) as the magnets 3, 3 in polarity-opposed relationship attract each other. The magnetically attractive force in horizontal direction functions to put the basic bodies 2, 2 near to each other and the magnetically attractive force in vertical direction functions to put the basic bodies near to each other in vertical direction. Even under the magnetically attractive force exerted in vertical direction, (the front end of) the projection 6 can smoothly slide on the magnet 3 without any significant frictional resistance, because the projection 6 is non-magnetic.

The magnets 3, 3 are firmly bonded to the respective basic bodies 2, 2 inside the non-magnetic frames 13 thereof and identical to each other in surface shape (rectangular shape in the illustrated embodiment) as well as in size. The pair of magnets 3, 3 are identical to each other in shape as well as in size and the frames 13 are non-magnetic, so the magnets 3, 3 attract each other reliably and stably in the predetermined position-relationship. While the surfaces of the magnets 3, 3 preferably come in close contact with each other, a limited gap (not shown) possibly left between these surfaces of the magnets would not affect the desired function of the clasp according to the present invention. To separate the basic bodies 2, 2 having been coupled together, these basic bodies 2, 2 may be moved away from each other in vertical direction against the magnetic force of the magnets 3, 3. In this way, these basic bodies can be easily coupled to each other in the predetermined position-relationship, even if the basic bodies can not be coupled together in the predetermined position-relationship by instantaneous operation of bringing them nearer to each other.

Each of the basic bodies 2, 2 is divided into the front half 9 and the rear half 10 substantially of same length. The rear halves 10 of the respective basic bodies 2 are formed in rear surfaces thereof with recesses 17 so that the entire basic bodies 2, 2 may be weight-saved. These recesses 17 are formed in the rear halves 10 of the respective basic bodies 2, 2 and therefore the rear halves 10 are weight-saved with respect to the front halves 9, i.e., the front halves are somewhat lighter than the rear halves so that the pair of basic bodies 2, 2 can be easily brought near to each other in vertical direction when the pair of front halves 9, 9 are brought near to each other and placed against each other.

The respective rear halves 10 are provided at rear ends thereof with anchoring means 20 surrounding openings 19 so that these anchoring means 20 may be attached to clothes or the like by means of thread, cord or the like (not shown). In the case of the clasp destined to be used with belt, the ends of the belt will be fixed in the openings 19 (not shown). It is possible to provide the rear halves 10 on rear sides thereof with leg-like anchoring means (not shown).

Figure 16:
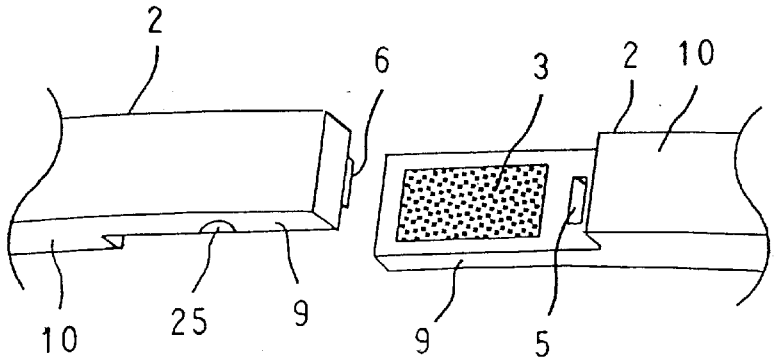
FIG. 16 is a scale-enlarged, perspective view showing another clasp partially in its unfastened state, lock means consisting a substantially cubic projection and a substantially cubic recess.

FIGS. 13~19 show an alternative embodiment of the clasp 31 according to the invention. The components and positions thereof similar to those in the previously described clasp 1 are designated by the similar reference numerals and details description thereof will be eliminated. The clasp 31 comprises the pair of basic bodies 2, 2, each having the front half 9 and the rear half 10. The opposed surfaces of the front halves 9, 9 as the basic bodies 2, 2 are coupled together, more specifically, each of the front halves 9, 9 is formed in transversely opposite sides 23 of the frame 13 with notches 25 opening outward, respectively. With the pair of basic bodies coupled together, the front halves 9, 9 are placed against each other under the attractive effect of the magnets vertically opposed to each other. From this state, finger tip or nail tip may be slightly inserted into the outwardly opening notches 24 formed on the transversely opposite side edges of the frame 13 and thereby the basic bodies 2, 2 may be easily disengaged from each other. While a pair of outwardly opening notches 25, 25 are preferably formed in the transversely opposite side edges 23, 23, respectively, it is possible to form such notch 25 only one of the transversely opposite side edges 23, 23. While FIG. 16 illustrates the notches 25 to be formed only on the one front half 9, i.e., the upper front half 9, it is also possible to form such notches 25 only on the lower front half 9 (not shown). Alternatively, it is also possible to form such notches 25 not only on the upper front half 9 but also on the lower front half 9 (not shown). As has previously been described, the front halves 9, 9 carrying the magnets 3, 3 are heavier than the rear halves 10, 10. The notches 25 serve to weight-save the front halves 9, 9 with respect to the rear halves 10, 10 and serve also to weight-save the entire the basic bodies 2, 2.

According to the former embodiment, the recess 5 and the projection 6 functioning together as the lock means are provided in the form of the cylindrical recess 5 and the cylindrical projection 6 (See FIG. 18). According to the latter embodiment, both the recess 5 and the projection 6 present cubic or rectangular parallelepidic shapes (See FIG. 19). In the latter embodiment, the basic bodies 2, 2 are prevented by these recess 5 and the projection 6 engaged with each other from rotating in horizontal direction. In this way, the basic bodies 2, 2 can be coupled together with high stability.

The rear halves 10, 10 are provided on the rear ends thereof with the anchoring means 20 surrounding the openings 19 so that thread, cord or the like (not shown) may be inserted into these openings 19 and thereby the basic bodies 2, 2 may be attached to clothes or the like (not shown). In the case shown by FIGS. 14 and 15, the respective rear halves are provided with dual anchoring means 20, 26 so that thread, cord or the like may be inserted into the openings defined by the respective anchoring means 20, 25 and thereby the basic bodies 2, 2 may be firmly attached with correspondingly high durability.

Effect of the Invention

As will be apparent from the foregoing description, the clasp according to the present invention facilitates the button for clothes, buckle for belt or the like to be fastened and unfastened using the magnetic force. In addition, the present invention ensures the clasp to be reliably and stably fastened.

IDENTIFICATION OF REFERENCE NUMERALS USED IN THE DRAWINGS:

| | |
|---|---|
| 1, 31 | clasp |
| 2 | basic bodies |
| 3 | magnets |
| 5 | recess |
| 6 | projection |
| 7 | level differentiating vertical surface |
| 9 | front half |
| 10 | rear half |
| 12 | boundary |
| 13 | frame |
| 15 | front end surface |
| 16 | upper surface |
| 17 | recess |
| 19 | opening |
| 20, 26 | anchoring means |
| 21 | corners |
| 23 | side edges |
| 25 | cutouts |

What is claimed is:

1. A clasp comprising a pair of basic bodies provided on mutually opposed surfaces thereof with a pair of magnets and recess and projection cooperation with each other to serve as lock means, respectively, said basic bodies adapted to be detachably coupled together as said projection is engaged with said recess and said magnets attract each other so that at least sliding shift of said basic bodies from each other in horizontal direction is restricted by engagement of said projection and recess, wherein the surfaces of said front halves opposed to each other as said pair of basic bodies are coupled to each other are formed with notches opening outward transversely of said front halves.

2. A clasp comprising a pair of basic bodies, each being divided by a level differentiating vertical surface into a front half and a rear half, said front half being defined by said level differentiating vertical surface and a level differentiating horizontal surface provided with a magnet and projection or recess serving as one of lock means so that the pair of basic bodies are detachably coupled to each other as said projection and recess come in engagement and said magnets attract each other wherein, once said pair of basic bodies have been coupled to each other, front end surfaces of the respective front halves bear against the associated level differentiating vertical surfaces and thereby restrict said pair of basic bodies from swinging around said projection and recess engaged with each other.

3. The clasp according to claim 2, wherein, once said pair of basic bodies have been coupled to each other with said pair of front halves engaged with each other, said pair of basic bodies are substantially flush with each other along a boundary of them.

4. The clasp according to claim 3, wherein the projection and the recess serving as the lock means are non-magnetic and the recess is formed in a frame.

5. The clasp according to claim 3, wherein the magnets are fixed inside respective non-magnetic frames.

6. The clasp according to claim 2, wherein one of said front halves is provided on its level differentiating horizontal surface with the magnet and the projection serving as one component of said lock means and the other front half is provided on its level differentiating horizontal surface with the magnet and the recess opposed to said projection and serving as the other component of said lock means so that the pair of basic bodies may be detachably coupled to each other as said projection is engaged with said recess and simultaneously said magnets attract each other.

7. The clasp according to claim 2, wherein one of said front halves is provided on a level differentiating horizontal surface with the magnet and the projection serving as one component of said lock means and the other front half is provided on its level differentiating horizontal surface with the magnet and the recess opposed to said projection and serving as the other component of said lock means so that the pair of basic bodies may be detachably coupled to each other as said projection is engaged with said recess and simultaneously said magnets attract each other.

8. The clasp according to claim 7, wherein, once a non-magnetic projection formed on the front half of the one basic body has come in contact with the upper surface of the rear half of the other basic body as the pair of basic bodies get nearer to each other, said projection is guided to slide on said upper surface of said rear half until said projection gets over a level differentiating vertical surface whereupon the magnets attract each other and simultaneously the projection is engaged with the recess opposed to said projection so that the pair of basic bodies are coupled to each other in a predetermined position-relationship.

9. The clasp according to claim 8, wherein, the upper surfaces of the respective rear halves are smooth.

10. The clasp according to claim 7, wherein, once a non-magnetic projection formed on the front half of the one basic body has come in contact with the upper surface of the magnet lying on the level differentiating horizontal surface of the other front half as the pair of basic bodies get nearer to each other, the pair of magnets get near to each other under the magnetic attraction and simultaneously the projection slides on the upper surface of said magnet toward the recess until the pair of magnets are magnetically coupled to each other and simultaneously the projection is engaged with the recess opposed to said projection so that the pair of basic bodies are coupled to each other in a predetermined position-relationship.

11. The clasp according to claim 7, wherein, the projection and the recess serving as the lock means are provided adjacent a front end of the one front half and adjacent a rear end of the other front half, respectively.

12. A clasp comprising a pair of basic bodies provided on mutually opposed surfaces thereof with a pair of magnets and recess and projection cooperation with each other to serve as lock means, respectively, said basic bodies adapted to be detachably coupled together as said projection is engaged with said recess and said magnets attract each other so that at least sliding shift of said basic bodies from each other in horizontal direction is restricted by engagement of said projection and recess, wherein the front half and the rear half are dimensioned to have a substantially same length and the rear halves are formed in lower sides thereof with recesses.

* * * * *